US005328150A

United States Patent [19]

Guativa

[11] Patent Number: 5,328,150

[45] Date of Patent: Jul. 12, 1994

[54] DIGITAL DAMPER ACTUATOR

[75] Inventor: Alfonso C. Guativa, Champaign, Ill.

[73] Assignee: The United States of America as represented by the Secretary of the Army, Washington, D.C.

[21] Appl. No.: 114,278

[22] Filed: Sep. 1, 1993

[51] Int. Cl.[5] ..... F16K 31/02

[52] U.S. Cl. ..... 251/129.1; 251/192.2; 335/256

[58] Field of Search ..... 251/129.05, 129.1, 129.2; 318/122; 335/256, 268

[56] References Cited

U.S. PATENT DOCUMENTS

| | | | |
|---|---|---|---|
| 2,856,484 | 10/1958 | Fairbanks | 251/129.1 X |
| 3,157,222 | 11/1964 | Hassa | 251/129.1 X |
| 3,190,608 | 6/1965 | Hassa | 251/129.1 X |
| 3,666,231 | 5/1972 | Parodi | 251/129.1 |
| 4,293,027 | 10/1981 | Tepe . | |
| 4,487,363 | 12/1984 | Parker . | |
| 4,491,061 | 1/1985 | Nishizawa . | |
| 4,530,395 | 7/1985 | Parker . | |
| 4,819,693 | 4/1989 | Rodder | 251/129.1 X |
| 4,829,447 | 5/1989 | Parker . | |
| 4,843,084 | 6/1989 | Parker . | |
| 4,931,948 | 6/1990 | Parker . | |

*Primary Examiner*—Robert G. Nilson

[57] ABSTRACT

The present invention digital damper actuator utilizes a sectioned coil made up of a number of independently energizable coils connected together. To energize/de-energize each of the sectioned coils, a digital signal, in the form of 1 or 0, is provided by a controller microprocessor to a corresponding relay. Thus, for example, if a 1 is provided to the relay, its corresponding sectioned coils is energized. And if a 0 signal is provided to the relay, the sectioned coils is de-energized. A portion of the shaft which acts as a plunger connected to a damper pivotally fitted within a air duct is slidably fitted within the sectioned coil. Thus, as each of the sectioned coils is energized/de-energize, the shaft is moved correspondingly to thereby incrementally open/close the damper to allow an increasing/decreasing amount of air to pass through the air duct. As the number of sections which make up the sectioned coils is increased, the resolution of the incremental opening/-closing of the damper is increased.

9 Claims, 1 Drawing Sheet

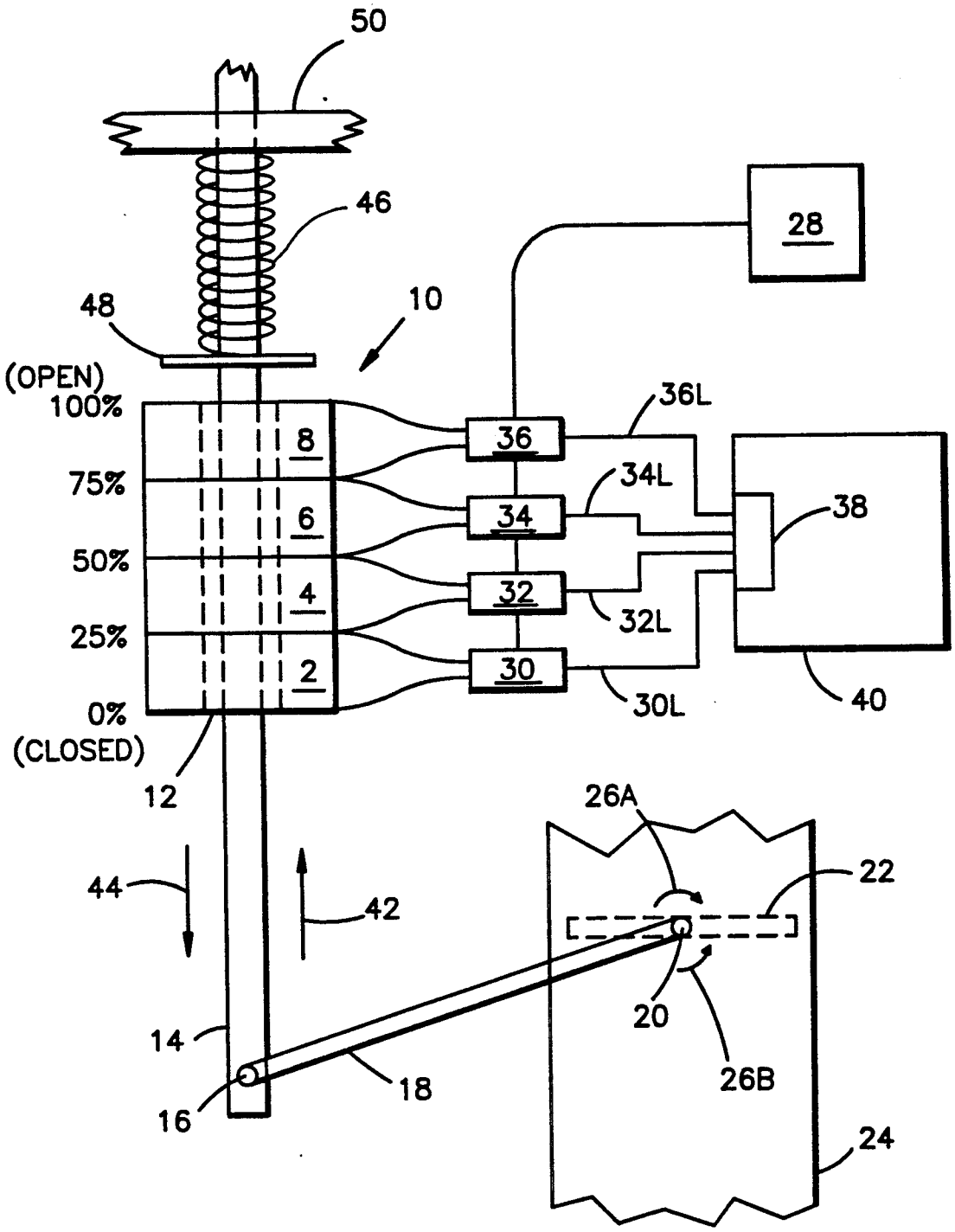
50
46
28
48
10
(OPEN)
100%
75%
50%
25%
0%
(CLOSED)
8
6
4
2
36
34
32
30
36L
34L
32L
30L
38
40
12
26A
22
44
42
20
26B
14
18
16
24

DIGITAL DAMPER ACTUATOR

FIELD OF THE INVENTION

The present invention relates to the control of the movement of a damper in an air duct of a heating ventilation and air conditioning (HVAC) system, and particularly to the direct control of the movement of the damper by means of the digital outputs from a microprocessor based HVAC controller.

BACKGROUND OF THE INVENTION

Conventionally, to control the movement of dampers in air ducts, pneumatic, electronic and electrical actuators are used. There are a number of disadvantages of using a pneumatic controller which include, for example, the drifting of the calibration point of the pneumatic controller over time, and the susceptibility of pneumatic lines to contamination from moisture due to condensation or lubricating oil from the compressor. Even though the current crop of HVAC electronic controllers are now microprocessor based, no reliable electronic actuators have yet been found. Moreover, with microprocessor based controllers, the old problems associated with pneumatic controllers have been replaced by a new set of problems which include the problem of converting different types of signals, as for example converting the digital signals output from the microprocessor to analog signals and further to pneumatic signals. There is therefore the added cost of the equipment for making those signal conversions. As for the electrical type of actuators that use motors and gears to drive the damper, experience has shown that the complexity of such actuators tends to make them unreliable and expensive.

BRIEF DESCRIPTION OF THE PRESENT INVENTION

The present invention digital damper actuator mechanism (DDA) overcomes the above-mentioned deficiencies of the prior art mechanisms by directly utilizing the digital signals provided from the microprocessor controller to effect the movement of the damper to regulate the amount of air flow through an air duct. In particular, the present invention DDA comprises a number of coils, each of which is energizable to produce a magnetic flux, connected in stages. A portion of a shaft, acting as a plunger, is inserted within the bore of the connected coils so as to be slidable axially through the bore of the coils. Rotatably coupled to one end of the shaft plunger is an extension which in turn is connected to the damper, pivotally mounted within an air duct. Each of the coils, per convention, is comprised of wire windings which, when provided with a current, generates a magnetic flux that pulls the shaft plunger along one direction.

To regulate the energization of each of the coils, an equal number of corresponding relays is provided, one per each coil. Each relay is responsive to the digital signals, in the form of 1's and 0's, output from the controller computer. Thus, instead of needing conversion equipment to convert the digital signals output from a computer to analog signals, as in the case of conventional pneumatic controllers, the instant invention DDA uses the digital signals directly output from the controller computer to control the energization of the each of the coils. And insofar as the coils are connected in stages, depending upon the number of stages and whichever stage(s) is (are) being energized, the damper can be incrementally pivoted to allow incremental increasing/decreasing amount of air flow to pass through the air duct.

There are therefore several advantages the present invention DDA has over the conventional type of actuators. For example, the digital signals output from the controller processor no longer need to be converted to analog signals. This in turn means that the 1's and 0's output from the computer can be used directly, through relays, to selectively energize/de-energize the different coil stages of the DDA. Secondly, insofar as digital to analog conversion of the signals is eliminated, the program which the controller processor requires can be written more efficiently. Thirdly, since the present invention DDA has only one moving part, i.e. the shaft plunger, it is much more reliable and simpler to manufacture than the conventional electrical actuators. Finally, insofar as each of the coils can be energized/de-energized almost instantaneously, the present invention DDA has a faster response time than a convention pneumatic actuator, which bleeds compressed air in or out, or an electrical actuator, whose gears are physically turned by a motor.

BRIEF DESCRIPTION OF THE FIGURE

The above-mentioned objectives and advantages of the present invention will become more apparent and the invention itself will be best understood by reference to the following description of the invention taking in conjunction with the accompanying drawing which illustrates the present invention digital damper actuator.

DETAILED DESCRIPTION OF THE PRESENT INVENTION

As shown in the figure, the present invention digital damper actuator (DDA) comprises, for the embodiment shown, a four stage coil assembly made up of stage coils 2, 4, 6 and 8, connected together as a sectioned coil 10. As shown, coil 10 has a bore 12 through which a portion of a shaft 14, being used as a plunger, is slidably fitted. With reference to the drawing, at the lower end of shaft 14 there is rotatably connected at a joint 16 an extension 18 whose other end has pivotally connected thereto at a joint 20 a damper 22, pivotally mounted within an air duct 24. Damper 22 is shown to be pivotable about joint 20 per directional arrows 26A (to open up damper 22 to allow air flow through air duct 24) and arrow 26B (to close damper 22 to prevent air flow through air duct 24).

As is well known, each stage (2, 4, 6, 8) of coil 10 may be independently energized by a power source 28, via for the present invention embodiment respective relays 30, 32, 34 and 36. Relays 30–36 each are a conventional relay whose contact closes in response to the receipt of a given voltage, for example a voltage representative of a 1 bit signal output from an input/output interface 38 of controller microprocessor 40. In actuality, for the instant 4 stage coil, it is assumed that there are 4 bits output from processor 40 at each clock pulse, in the form of 0000 to 1111. Thus, when a 1 (0001) is provided from processor 40 to line 30L, relay 30 is activated to close its contact to thereby effect an electrical path between power source 28 and stage 2 of coil 10 to enable the latter to be energized by the former. Thus energized, stage 2 of coil 10 produces a magnetic flux which in turn would partially pull shaft 14 axially through bore 12 along the direction indicated by directional arrow 42.

For the being illustrated embodiment, insofar as coil 10 is comprised of 4 stages, upon energization of stage 2, shaft 14 is pulled longitudinally per direction 42, at only at 25% of the total possible displacement. Accordingly, damper 22 is pivoted incrementally a quarter of the turn, i.e. opens only one quarter of the way to allow air flow through air duct 24.

When the second stage 4 of coil 10 is next activated, i.e. when a second signal having a 0011 format is provided to line 32L from processor 40 to relay 32, shaft 14 is further pulled per direction 42 to provide a 50% displacement of shaft 14 to thereby further pivot damper 22 to provide yet a larger opening to allow additional air flow to pass through air duct 24. If yet a greater amount of air flow is desired, stage 6 of coil 10 can be energized by the provision of yet a third signal (0111) from processor 40 to relay 34 via line 34L. Of course, if damper 22 were to be completely opened, a 1 signal (1111) would be provided on each of lines 30L to 36L to close the respective contacts of relays 30–36 to thereby provide current to each stage 2–8 of coil 10.

When it is desirable to close damper 22 either incrementally or completely, selected ones of stages 2, 4, 6 and 8 of coil 10 may be energized/de-energized by having a 0 signal sent to the respective relays 30, 32, 34 and 36 from processor 40. Upon de-energization, as for example when 0's (0000) are provided to each of lines 30L, 32L, 34L and 36L, since magnetic flux is no longer present in any one of the sections 2, 4, 6 and 8 of coil 10, shaft 14 would be pushed longitudinally through bore 12 along direction 44 by a compression spring 46, mounted about shaft 14 and located between biased plate 48 and frame 50. Of course, if only one section, for example section 8 of coils is de-energized (0111), shaft 14 would be returned to only 75% of its originally displacement, with damper 22 being opened at 75%. It follows then that if section 6 is next de-energized (0011), shaft 14 would be returned to its 50% position, with damper 22 being opened half way to allow 50% of the air flow to pass through air duet 24.

For the embodiment in the figure, a four stage digital damper actuator is shown. However, it should be appreciated that the number of stages which make up coil 10 can be varied, say from a basic 1 stage coil to a multiple number of stages (preferably an even number), depending on the output from processor 40. For example, with a 1 stage coil 10, upon activation of its corresponding relay by the output of a 1 signal from processor 40, damper 22 would be opened, either completely or at a preset open value. And with a provision of a 0 signal, damper 22 will be closed.

On the other hand, if the present invention digital damper actuator is made of 8 stages, then the movement of the damper could be made in increments of 12.5% (i.e. 100+8). Similarly, if the present invention digital damper actuator comprises a 16 stage coil, the movement may be in increments of approximately 6.2% (100+16). If a 32 stage coil 10 is used, increments of approximately 3.2% (100+32) could be achieved. A 64 stage coil would yet provide finer incremental movements, i.e. 1.6% per each section of energized/de-energized coil. Do note that the different stage members, namely 8, 16, 32 and 64, are the number of bits upon which a computer, for example processor 40, operates. In other words, an 8 stage. coil would have an 8 bit format; a 16 stage coil a 16 bit format; a 32 stage coil a 32 bit format; a 64 stage coil a 64 bit format, etc. Thus, it should be appreciated that the number of stages could be any number, within reason, as long as the desired incremental resolution is obtainable.

Inasmuch as the present invention is subject to many variations, modifications and changes in detail, it is intended that all matter described throughout this specification and shown in the accompanying drawing be interpreted as illustrative only and not in a limiting sense. Accordingly, it is intended that the invention be limited only by spirit and scope of the hereto attached claims.

I claim:

1. Apparatus for regulating the amount of air flow through an air duct comprising:

at least four electrically energizable magnetic coils effecting actuator incremental movements;

a shaft having a portion thereof slidably fitted within the bore of said coils and movable therealong in response to energization/de-energization of said coils;

a damper positionable within said air duct coupled to said shaft;

means responsive directly to digital signals from a control computer to energize/de-energize said coils;

whereby said damper is selectively positioned within said air duct in response to the movement of said shaft to thereby regulate the amount of air flow through said air duct.

2. Apparatus of claim 1, wherein said responsive means commprises a set of relays; and wherein said digital signals comprise respective 1's and 0's output from said computer, said relays responsive to said 1's and 0's to energize and de-energize said coils, respectively.

3. Apparatus of claim 1, wherein said damper is pivotally positioned within said air duct so as to open when said coils are energized and close when said coils are de-energized.

4. Apparatus of claim 1, at least four electrically energizable coils connected together in stages, each of said coils independently energizable by a corresponding relay responsive to a set of digital signals output from said computer;

wherein said shaft portion is slidable within the bore formed by said connected together coils in response to respective energization of said coils to thereby maneuver said damper to incrementally regulate the amount of air flow through said air duct.

5. Apparatus for regulating the amount of air flow through an air duct, comprising:

a plurality of energizable coils connected in series to form a sectioned coil whose each section is independently energizable/de-energizable;

a shaft having a portion thereof slidable axially through the bore of said sectioned coil;

multiple means each responsive directly to a corresponding pair of digital signals output from a control computer to energize/de-energize a respective section of said sectioned coil;

a damper positionable within said air duct coupled to said shaft;

wherein each of said sections, when energized, moves said shaft axially along a portion of said bore such that, as each successive section of said sectioned coil is energized, said shaft is incrementally moved along a given direction; and whereby said damper is positioned within said air duct in response to the incremental movement of said shaft to regulate the amount of air flow through said air duct.

6. Apparatus of claim 5, wherein each said pair of digital signals comprise 1's and 0's output from said computer; and wherein each of said multiple responsive means comprises a relay responsive to said 1's and 0's to energize/de-energize its respective section of said sectioned coil to control the movement of the portion of said shaft across said respective section.

7. Apparatus of claim 5, wherein said damper is pivotally positioned within said air duct to pivot in response to the axial movement of said shaft through said bore as said respective successive sections of said sectioned coils is energized/de-energized.

8. Apparatus of claim 5, wherein said plurality of energizable coils comprises an even number of coils.

9. Apparatus of claim 6, wherein said each relay is energized in response to said 1's and de-energized in response to said 0's; and wherein said shaft is incrementally moved along a given direction in response to the energization of successive sections of said sectioned coil to incrementally position said damper to correspondingly increase the amount of air flow through said air duct.

* * * * *